US005487582A

United States Patent [19]

Bourgeois et al.

[11] Patent Number: 5,487,582

[45] Date of Patent: Jan. 30, 1996

[54] DETACHABLE SHOPPING BAG HANDLE

[76] Inventors: Barbara S. Bourgeois; Kim S. Dupuis, both of 3107 Orris La., Apartment 110, Metairie, La. 70002

[21] Appl. No.: 354,524

[22] Filed: Dec. 13, 1994

[51] Int. Cl.[6] ..... A45C 13/26; B65D 33/06

[52] U.S. Cl. ..... 294/146; 294/171

[58] Field of Search ..... 294/137, 138, 294/142, 146, 149–157, 165, 170, 171; 16/110 R, 110.5, 114 R, 114 B, 125; 190/116; 229/117.09, 117.19, 117.23–117.25; 383/6, 13, 25, 29

[56] References Cited

U.S. PATENT DOCUMENTS

| | | | |
|---|---|---|---|
| 245,369 | 8/1881 | Gay | 16/110.5 X |
| D. 314,150 | 1/1991 | Preciutti | D9/455 |
| D. 329,973 | 10/1992 | Schuttings | D6/300 |
| 784,972 | 3/1905 | Barton | 294/138 |
| 2,274,605 | 2/1942 | Hoffmeister | 294/171 X |
| 3,554,417 | 1/1971 | Yorty | 294/149 |
| 3,913,172 | 10/1975 | Richards et al. | 16/114 B |
| 4,262,385 | 4/1981 | Norman | 294/171 X |
| 5,005,891 | 4/1991 | Lunsford | 294/137 |
| 5,083,825 | 1/1992 | Bystrom et al. | 294/171 |
| 5,199,758 | 4/1993 | Howell | 294/171 |
| 5,257,845 | 11/1993 | McConnell | 294/137 |

*Primary Examiner*—Johnny D. Cherry
*Attorney, Agent, or Firm*—Joseph N. Breaux

[57] ABSTRACT

A detachable shopping bag handle comprising: a flexible member having a padded portion, and a fastening mechanism for fastening the flexible member about a handle of a shopping bag. The flexible member includes a first and second surface and is preferably constructed from a woven fabric material such as cotton. The padded portion is preferably enclosed between layers of the woven fabric and stitched into place in a quilted fashion. The fastening mechanism includes a first and second section of hook and pile type fastener. The first section is attached to the first surface of the flexible member. The second section is attached to the second surface. The first and second sections are located at opposite ends of the flexible member. The flexible member may also include an eyelet member and/or a pocket member attached to the second surface of the flexible member.

1 Claim, 2 Drawing Sheets

DETACHABLE SHOPPING BAG HANDLE

TECHNICAL FIELD

The present invention relates to devices for carrying shopping bags having flexible handles and more particularly to devices for carrying shopping bags having flexible handles that include a cushioned surface for supporting the flexible handles.

BACKGROUND ART

Shopping for large numbers of items can be a tiring experience. In addition to long lines and slow service, carrying the already purchased items in the shopping bag provided can be difficult and often impossible for people with hand disorders such as arthritis. The flexible handles provided on most flexible shopping bags can dig into unprotected hands leaving painful and unsightly marks. It would be a benefit, therefore, to have a personal handle, which could be carried with the shopper and detachably affixed to the existing handles of a shopping bag, that would eliminate the occurrence of these painful unsightly marks.

The following patents are illustrative of various attempts made to solve this problem.

| U.S. Pat. No. | Inventor |
|---|---|
| 5,257,845 | McConnell |
| 5,199,758 | Hewell |
| 5,005,891 | Lunsford |
| 3,913,172 | Richards |
| Des. 329,973 | Schuttings |
| Des. 314,150 | Preciutti |

McConnell discloses a detachable hand grip for carrying bags and the like that includes a flexible flat body having a slit extending from each end for receiving the flexible handles of a shopping bag.

Hewell discloses a rigid carrier apparatus for carrying packages formed in the configuration of a tubular body having opposite ends and a slot spiraling through the body between the opposite ends.

Lunsford discloses a bag handle apparatus comprising a thin sheet of semi-rigid flexible material having a locking tab formed on one end, and a locking slot formed in a second end of the sheet. The locking tab lockingly engages the locking slot to hold the bag handle apparatus in a generally arcuate shape about one or more bag handles.

Richards discloses an elongated block including a longitudinal channel therein opening outwardly of one longitudinal side of the block as well as its opposite ends. The channel may receive rope or equivalent shopping bag handles therein and a closure panel extending longitudinally of the block is provided for closing channel.

Schuttings discloses a handle for shopping bags having a contoured finger grip. Preciutti discloses a carrying handle for grocery bags having a slotted section for receiving individual bag handles and an elastic band for securing the handles within each slot.

All of the above mentioned devices include rigid or semi-rigid elements which may come into contact with the bag handle and cause the bag handle to break. In addition, because of the rigid nature of these devices they can be uncomfortable to store and carry when not in use. It would be desirable, therefore, to have a detachable shopping bag handle which did not include any rigid parts in contact with the shopping bag handle and which was comfortably stored and carried within a pocket when not in use.

GENERAL SUMMARY DISCUSSION OF INVENTION

It is thus an object of the invention to provide a detachable shopping bag handle that will not add greater stress to the handle of the shopping bag.

It is a further object of the invention to provide a detachable shopping bag handle that has a thick cushioned pad to protect the hands and fingers of the user.

It is a still further object of the invention to provide a detachable shopping bag handle that has a mechanism for attaching keys and the like to facilitate entry into a locked building.

It is a still further object of the invention to provide a detachable shopping bag handle that may be easily and thoroughly cleaned.

Accordingly, a detachable shopping bag handle is provided. The detachable shopping bag handle composes: a flexible member having a padded portion, and a fastening mechanism for fastening the flexible member about a handle of a shopping bag. The flexible member includes a first and second surface and is preferably constructed from a woven fabric material such as cotton. The flexible member is preferably substantially rectangular or oblong in shape having a length between six and ten inches and a width between four and eight inches.

The padded portion is preferably enclosed between layers of the woven fabric and stitched into place in a quilted fashion. The padded portion must cover a central portion of the flexible member but may be of substantially the same size as the flexible member. The padded portion is preferably constructed from about ½" thick fiberfill.

The fastening mechanism includes a first and second section of hook and pile type fastener. The first section is attached to the first surface of the flexible member. The second section is attached to the second surface. The first and second sections are located at opposite ends of the flexible member. It is preferred that the first and second sections extend substantially the entire width of the flexible member and that each section be located between one-half and one and one-half inches from the perimeter of the flexible member.

In a preferred embodiment, the flexible member further includes an eyelet member having an aperture therethrough of sufficient dimensions to allow a ring member to pass therethrough. When the flexible member includes an eyelet member, a ring member may also be provided and installed through the aperture. The ring member should be of the type adapted to pass through a hole formed in a base portion of a key.

In another preferred embodiment, the flexible member further includes a pocket member attached to the second surface of the flexible member. The pocket member may be a patch type pocket and may include a flap section for retaining items within the pocket.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
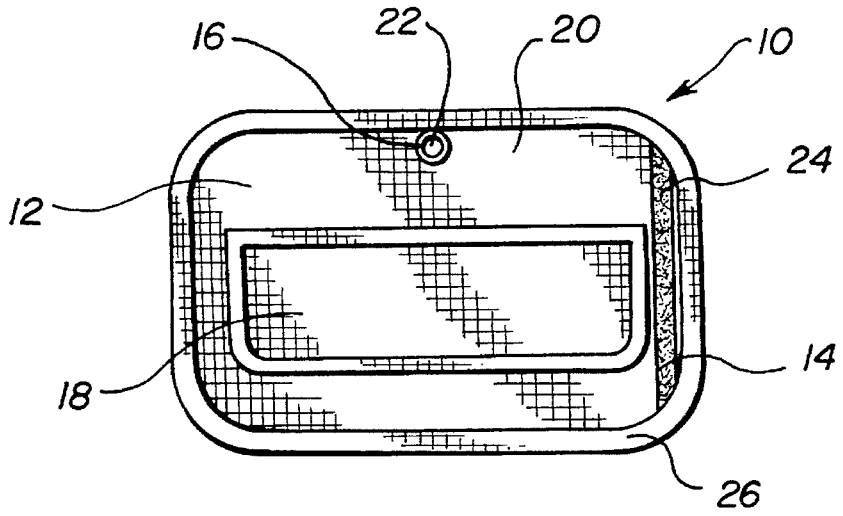
FIG. 1 is a top view of the second surface of an exemplary embodiment of the detachable shopping bag holder of the present invention.

FIG. 1 is a top view of one embodiment of the detachable shopping bag handle of the present invention generally designated by the numeral 10. In this embodiment, handle 10 includes a flexible member 12, a fastening mechanism 14, an eyelet member 16, and a pocket member 18.

Flexible member 12 is constructed from two, 6"×8" sections of denim cloth which are rounded at the corners. One of the 6"×8" sections forms a first surface 28 (shown in FIG. 3), the other section forms a second surface 20. The first and second surfaces are connected along their perimeters by a perimeter binding 26 therearound. Second surface 20 has a 3"×6" section of denim cloth stitched to its center which forms pocket member 18. Pocket member 18 is suitable for storing credit cards, cash, coupons, etc.

Eyelet member 16 is a metal grommet having an internal aperture 22 of about three-eighths of an inch. Aperture 22 passes completely through flexible member 12 and is suitable for receiving a key ring therethrough. A first strip 24 of hook and pile type fastener is attached along one of the shorter sides of flexible member 12.

Figure 2:
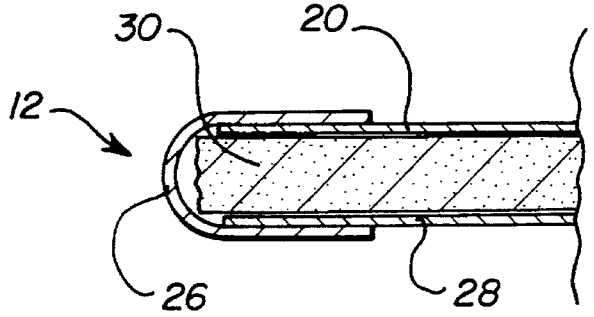
FIG. 2 is a top view of the first surface of an exemplary embodiment of the detachable shopping bag holder of the present invention.

FIG. 2 is a cross-sectional detail view showing the construction details of flexible member 12. Shown in the figure are first surface 28, second surface 20, perimeter binding 26 and a section of ½" inch thick, fiberfill padding material 30. Padding material 30 is substantially the same size and shape as first surface 28 and second surface 20. Padding material 30 is sandwiched between first and second surfaces 28,20. Perimeter binding 26 is then positioned about the perimeter and stitched in place. First surface 28, padding material 30, and second surface 20 are then stitched in a quilting pattern to secure the padding material 30 in place.

Figure 3:
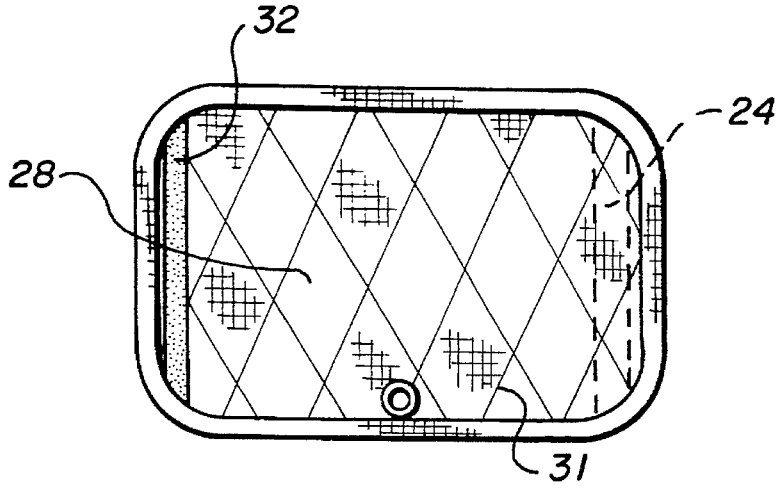
FIG. 3 is a cross-sectional detail view showing the arrangement of the first and second surfaces, the padding portion, and binding of the detachable shopping bag holder shown in FIGS. 1 and 2.
Figure 4:
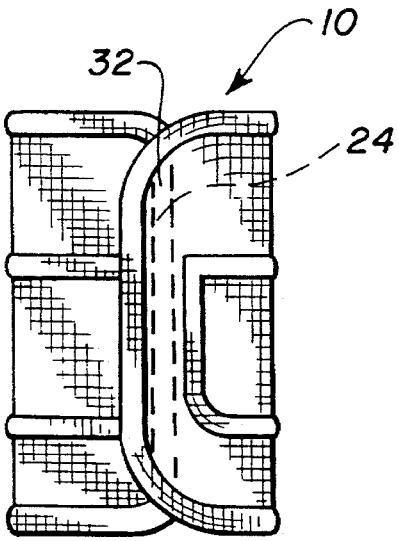
FIG. 4 is a side view showing the detachable shopping bag holder of FIG. 1 in the closed configuration.
Figure 5:
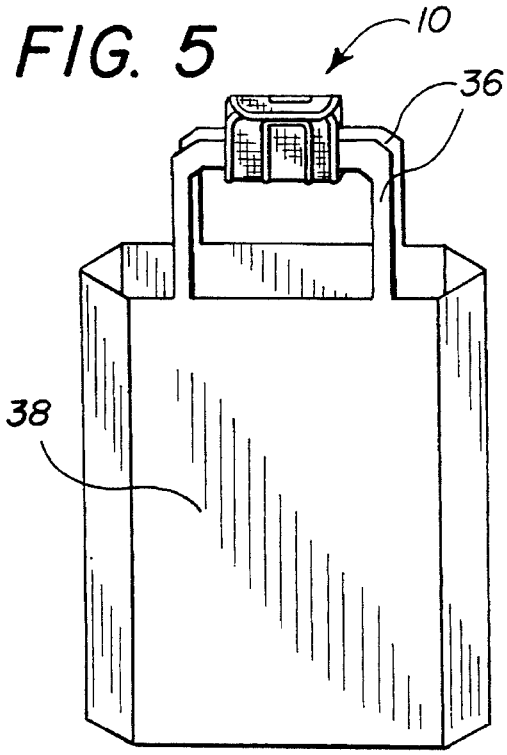
FIG. 5 is a side view showing the detachable shopping bag holder of FIG. 1 attached to the handles of a representative shopping bag.

FIG. 3 is a top view of first surface 28 showing a second strip 32 of hook and pile type fastener is attached along the shorter side of flexible member 12 at the end opposite first strip 24. Also shown is a preferred quilting pattern 31 used to secure padding material 30 into place. As shown in FIG. 4, first and second strips 24,32 connect with each other to form a tubular shaped handle 10. FIG. 5 shows handle 10 in position about the existing handles 36 of a typical shopping bag 38.

Figure 6:
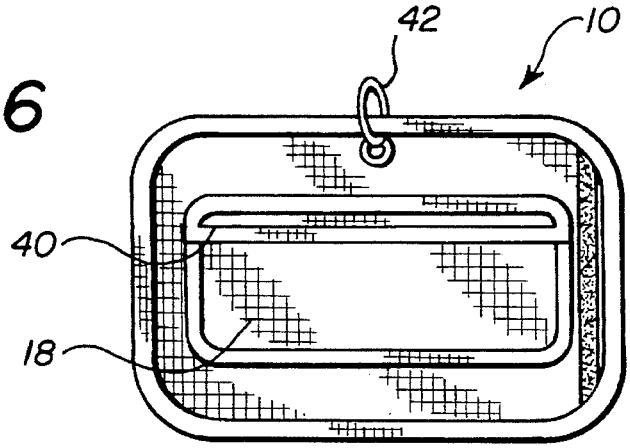
FIG. 6 is a top view of the second surface of another embodiment of the detachable shopping bag holder of the present invention which includes a flap portion and a key ring.
Figure 7:
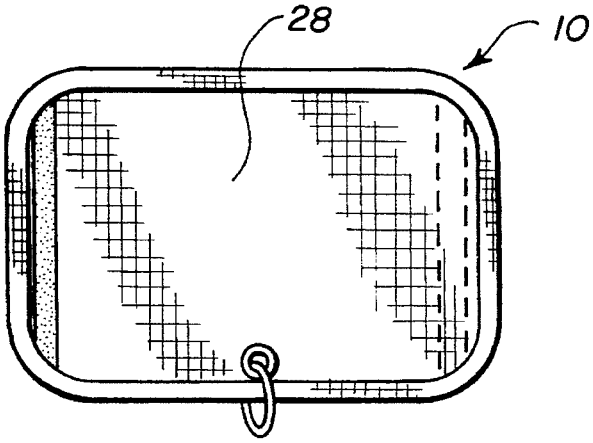
FIG. 7 is a top view of the first surface of the embodiment of the detachable shopping bag holder shown in FIG. 6.

FIG. 6 shows another exemplary embodiment of detachable shopping bag handle 10. In this embodiment, pocket member 18 is provided with a flap member 40 which is stitched adjacent to the opening of pocket member 18. Flap member 40 is constructed from the same fabric as pocket member 18. The use of a flap member 40 helps keeps items placed within pocket men, her 18 within pocket 18. Also included in this embodiment is a key ring 42 which is installed through aperture 22 of eyelet 16. Key ring 42 allows a user to conveniently attach a house key to handle 10, and eliminates fumbling for the key when carrying heavy packages. FIG. 7 shows the first surface 28 of the embodiment shown in FIG. 6. The flexible construction materials and padding provides cushioning for the hand while eliminating extra stress on the shopping bag handles by eliminating contact with any rigid materials.

It can be seen from the preceding description that a device for carrying shopping bags and the like having flexible handles which will not add greater stress to the handle of the shopping bag, has a thick cushioned pad to protect the hands and fingers of the user, has a mechanism for attaching keys and the like to facilitate entry into a locked building, and may be easily and thoroughly cleaned has been provided.

It is noted that the embodiment of the detachable shopping bag handle described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A detachable shopping bag handle comprising:

a first substantially rectangular, flexible, woven fabric member having a length between four and ten inches, a width between four and eight inches, and a first and second surface;

a second substantially rectangular, flexible, woven fabric member having a third and fourth surface and having a length and width substantially identical to said first fabric member;

a substantially rectangular, about one-half inch thick, padded portion, having a length and width substantially identical to said first fabric member, disposed between said first surface of said first fabric member and said third surface of said second fabric member and stitched in place with a first stitch set containing at least three substantially parallel lines of stitching and a second stitch set containing at least three substantially parallel lines of stitching, said first stitch set intersecting said second stitch set;

a binding wrapped about an entire first and second perimeter edge, respectively, of said first and second fabric members and stitched in place in a manner such that each stitch in said stitching passes through said binding twice, said first fabric member once, said padded portion once, and said second fabric member once;

a pocket member, constructed from a flexible fabric, attached to said second surface of said first fabric member defining a cavity, between said pocket member and said second surface, extending substantially the entire length of said first fabric member, having an opening running substantially the entire length of said pocket member along a first edge of said pocket member;

a flap member stitched to said second surface of said first flexible member in a manner to cover said opening;

a first section of hook material from a hook and pile type fastener attached to said second surface of said first flexible member;

a second section of pile-material from a hook and pile type fastener attached to said fourth surface of said second flexible member;

an eyelet member, secured through three concentric apertures formed through said first flexible member, said padded portion, and said second flexible member adjacent and centered along a short edge thereof, having an aperture therethrough of sufficient dimensions to allow a ring member to pass therethrough; and a ring member installed through said aperture said ring member being adapted to pass through a hole formed in a base portion of a key.

* * * * *